United States Patent [19]

Steinberg et al.

[11] Patent Number: 4,473,777

[45] Date of Patent: Sep. 25, 1984

[54] ELECTRON EMITTER ASSEMBLY

[75] Inventors: George N. Steinberg, Westport; W. Derek Buckley, Easton, both of Conn.

[73] Assignee: The Perkin-Elmer Corporation, Norwalk, Conn.

[21] Appl. No.: 427,201

[22] Filed: Sep. 29, 1982

[51] Int. Cl.[3] ..... H01J 29/04

[52] U.S. Cl. ..... 315/98; 313/342; 315/99; 315/334

[58] Field of Search ..... 315/94, 98, 99, 334, 315/338, 344, 345; 313/155, 342, 446

[56] References Cited

U.S. PATENT DOCUMENTS 2,611,112 9/1952 Kuthe et al. ..... 315/99

*Primary Examiner*—Eugene R. Laroche

*Attorney, Agent, or Firm*—Edwin T. Grimes; Thomas P. Murphy

[57] ABSTRACT

Disclosed herein is an electron emitter assembly for an electron gun which includes a first emitter ring, a second emitter ring, a power supply, connectors for connecting the power supply to the two electron emitter rings so that heating current flows from the power supply through the rings, and said rings being mounted so that a magnetic field formed by the second ring counteracts the magnetic field formed by the first ring.

7 Claims, 6 Drawing Figures

ELECTRON EMITTER ASSEMBLY

FIELD OF INVENTION

This invention relates to electron guns and, more particularly, to a new and improved electron emitter assembly for an electron gun. Electron emitter assemblies constructed in accordance with the concept of this invention are particularly adapted, among other possible uses, for use in x-ray lithography apparatus.

BACKGROUND OF INVENTION

Heretofore, it was conventional to utilize a gun fabricated out of four sections of fine tungsten helical wire bent into a quarter section of a circle. When energized, the helical wire moves after a short period of time and shorts to the gun body and/or moves out of the focusing well to produce a larger than desired focal spot. In addition, the assembly of the gun was complicated and required three to four days to complete.

Therefore, it is an object of the present invention to provide a new electron emitter assembly which overcomes, or at least mitigates, the problems encountered with the prior art.

SUMMARY OF THE INVENTION

Briefly, this invention contemplates the provision of a new and improved electron emitter assembly for an electron gun which includes, in combination, a first electron emitter ring, a second electron emitter ring, a power supply, and means for electrically connecting the power supply to the two electron emitter rings. In addition, means are provided for mounting the rings so that a magnetic field formed by the second ring counteracts a magnetic field formed by the first ring. According to one aspect of the invention, the rings are mounted adjacent to each other so that the heating current flows in one direction in one ring and in the opposite direction in the other ring. According to the invention, in one form thereof, the rings are fabricated from flat sheet stock and each ring has two oppositely disposed conducting tab portions and the ring portions only are deformed into sections of cones, respectively. According to the invention, in another form thereof, the rings are omega-shaped, respectively.

In one form of the invention, the rings are hoop-like ribbon structures and one ring has a smaller diameter than the other ring. The inner surface of the inner ring has a concave configuration.

According to one aspect of the invention, the rings are fabricated of a material selected from the class consisting of tungsten, thoriated tungsten and tantalum.

A feature of the new and improved electron emitter assembly according to the present invention resides in the provision of such a system, which is ideally suited for use in x-ray lithography apparatus. Another feature of the invention resides in a new emitter assembly which minimizes the magnetic field effects on electron trajectories, and which can employ "off the shelf" ceramics of non-critical dimensions.

Still another feature of the present invention resides in the provision of a new and improved electron emitter assembly, which employs a mechanically rigid structure and which is simple to assemble.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as a basis of the designing of other structures for carrying out the purpose of the invention. It is important, therefore, that this disclosure be regarded as including such equivalent constructions as do not depart from the spirit and scope of the invention.

Several embodiments of the invention have been chosen for purposes of illustration and description, and are shown in the accompanying drawings, forming a part of the specification.

DETAILED DESCRIPTION OF THE INVENTION

Electron emitter assemblies constructed according to the invention are particularly adapted for use in x-ray lithographic apparatus such as, for example, the electron gun assembly described in U.S. patent application Ser. No. 412,461, filed Aug. 30, 1982, the disclosure of which is incorporated herein by reference.

Figure 1:
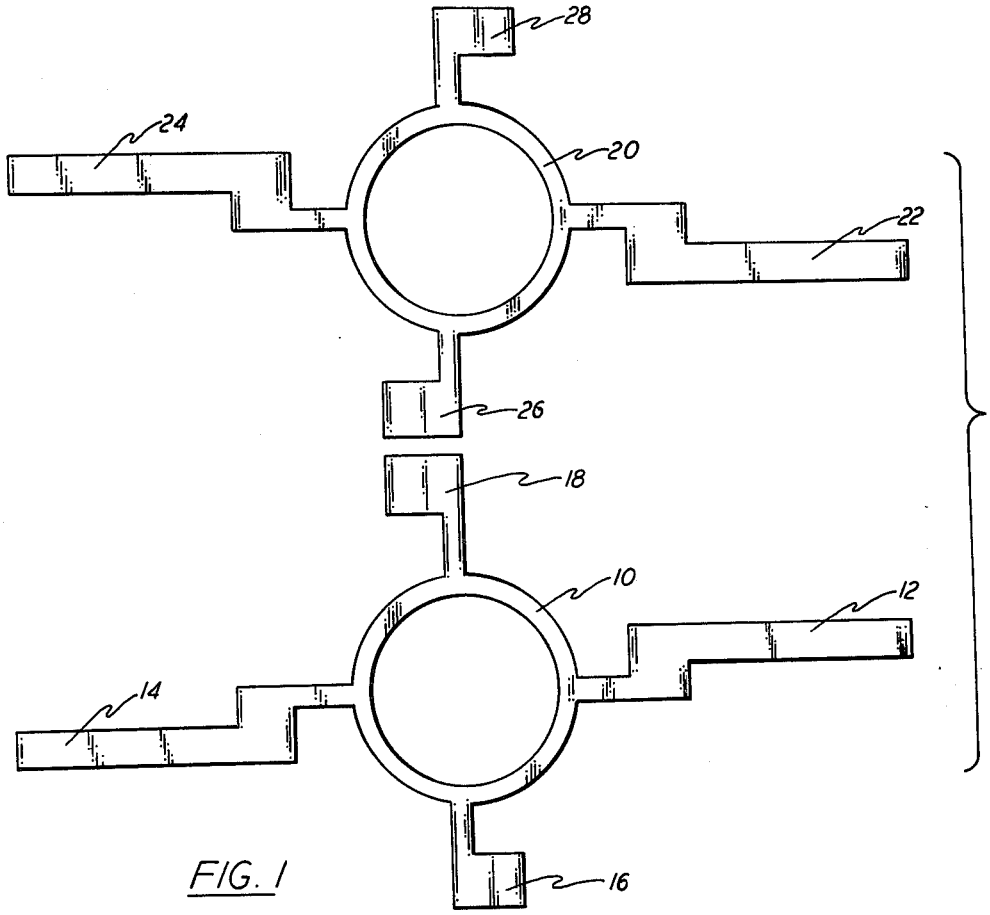
FIG. 1 is a plan view of the electron emitter rings prior to fabrication into an electron emitter assembly.
Figure 2:
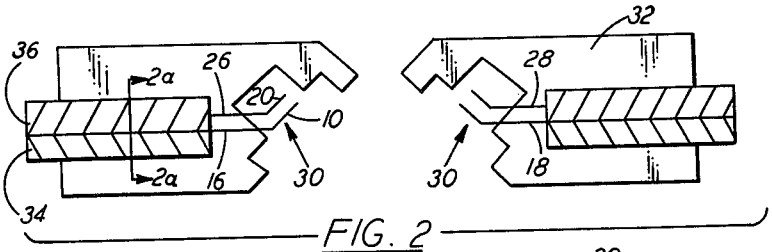
FIG. 2 is a transverse sectional view of an electron emitter assembly according to the invention.
Figure 3:
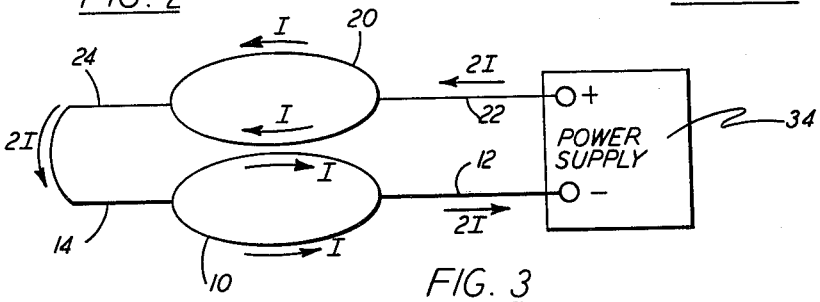
FIG. 3 is a schematic view of the electron emitter assembly showing the heating current flow pattern.

In the embodiment of the invention illustrated in FIGS. 1–3, the electron emitter assembly comprises, in combination, a first electron emitter ring 10 having a pair of oppositely disposed conducting tabs 12 and 14, and a second pair of oppositely disposed supporting tabs 16 and 18. As best seen in FIG. 2, a second electron emitter ring 20 is similarly fashioned, but of slightly larger diameter so that it can be placed in close proximity behind the first ring. Reverting to FIG. 1, the second ring 20 has a pair of oppositely disposed conducting tabs 22 and 24, and a second pair of oppositely disposed supporting tabs 26 and 28. Both rings are fabricated from flat sheet stock and the ring portions only are deformed into sections of a cone of preselected desired angles, respectively, as indicated at 30 in FIG. 2.

Figure 2A:
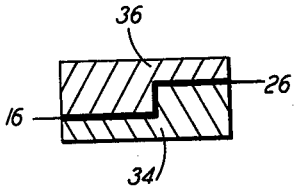
FIG. 2*a* is a sectional view taken along the line indicated at 2*a*—2*a* in FIG. 2.

Referring to FIGS. 2 and 2*a*, for purposes of mounting the electron emitter assembly in an electron gun body 32, the flat support tabs 16, 18 of the first ring and 26, 28 of the second ring are sandwiched, respectively, between two flat but stepped ceramic plates 34, 36, which electrically isolates the two rings from each other and from the gun body 32. The gun body is shaped to focus the emitted electrons to a spot on an anode, not shown, of the order of about 1.5 mm in diameter.

As best seen in FIG. 3, the two ring filaments are mounted in proximity to each other, and with counter flowing heating currents to minimize magnetic field effects on the electron trajectories. That is, the conducting tab 22 of the second ring 20 is connected to a power supply 34 and carries a current 2I. The ring proper splits the current whereby each half thereof passes a current I. The split current joins at a second conducting tab 24 which is electrically connected to the conducting tab 14 of the first ring 10 and carries a current of 2I. Then the first ring proper splits the current whereby each half thereof passes a current I. Finally, the split current joins at a conducting tab 12, where a current of 2I returns to the power supply 34 to complete the circuit. Thus, in adjacent portions of the first and second rings, the current flows in opposite directions and, as a result, the magnetic fields produced tend to counteract each other and thereby minimize the magnetic field effects on the electron trajectories.

Figure 4:
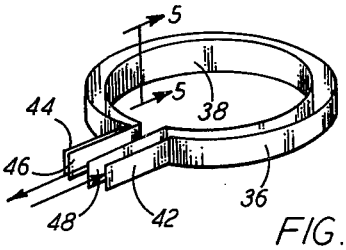
FIG. 4 is a perspective view of another embodiment of the invention.
Figure 5:
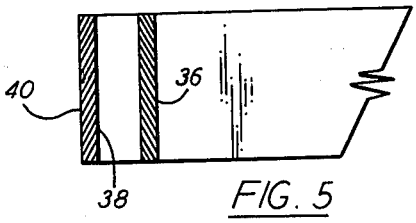
FIG. 5 is a sectional view taken along the line indicated at 5—5 in FIG. 4.

FIG. 4 shows another embodiment of the invention comprising a modular double-omega-shaped emitter assembly. In the embodiment illustrated, an outer hoop-like ribbon structure or ring 36 of tungsten having a thickness of the order of about 0.25 mm is connected in series electrically with an inner hoop-like ribbon structure or ring 38 of thoriated tungsten having a thickness of the order of about 0.20 mm. As best seen in FIG. 5, the innermost surface 40 of the double loop has first been machined to form a concave surface. The shape of the surface is determined by the electron trajectories. Reverting to FIG. 4, the heating current from a power supply, not shown, enters a first conducting tab 42 extending from the outer ring 36 and passes around the loop in a counter-clockwise direction as viewed in FIG. 4 to a second conducting tab 44, which is in electrical contact with a first conducting tab 46 of the inner ring 38. The heating current flows in a clockwise direction as viewed in FIG. 4 in the inner ring and exits the assembly by way of a second conducting tab 48 of the inner ring. As a result, in adjacent portions of the inner and outer rings 36, 38 the current flows in opposite directions and, as a result, the magnetic fields produced tend to counteract each other and thereby minimize the magnetic field effects on the electron trajectories.

The rings 10, 20 and 36, 38 can be fabricated from any suitable material, such as, for example, tungsten, thoriated tungsten, or tantalum.

It will thus be seen that the present invention does indeed provide an improved electron emitter assembly and effectively meets the objects specified hereinbefore.

Although particular embodiments of the invention are herein disclosed for purposes of explanation, various modifications thereof, after study of this specification, will be apparent to those skilled in the art to which the invention pertains.

What is claimed is:

1. An electron emitter assembly for an electron gun comprising, in combination, a first electron emitter ring, a second electron emitter ring, a power supply, means for electrically connecting the power supply to the two electron emitter rings so that heating current flows from the power supply through the rings, said rings being mounted adjacent each other so that the heating current flows in one direction in one ring and in the opposite direction in the other ring so that a magnetic field formed by said second ring counteracts a magnetic field formed by said first ring; and both of said rings being fabricated from flat sheet stock and each ring having two oppositely disposed conducting tab portions and the ring portions only being deformed into sections of cones, respectively.

2. An electron emitter assembly according to claim 1 wherein said rings are sandwiched between two flat ceramic plates.

3. An electron emitter assembly for an electron gun comprising, in combination, a first electron emitter ring, a second electron emitter ring, a power supply, means for electrically connecting the power supply to the two electron emitter rings so that heating current flows from the power supply through the rings, said rings being mounted adjacent each other so that the heating current flows in one direction in one ring and in the opposite direction in the other ring so that a magnetic field formed by said second ring counteracts a magnetic field formed by said first ring; and said rings being omega-shaped, respectively.

4. An electron emitter assembly according to claim 3 wherein each ring has two adjacent conducting tab portions, and the tab portions of one ring are disposed adjacent the tab portions of the other ring.

5. An electron emitter assembly for an electron gun comprising, in combination, a first electron emitter ring, a second electron emitter ring, a power supply, means for electrically connecting the power supply to the two electron emitter rings so that heating current flows from the power supply through the rings, said rings being mounted adjacent each other so that the heating current flows in one direction in one ring and in the opposite direction in the other ring so that a magnetic field formed by said second ring counteradts a magnetic field formed by said first ring; and said rings being hoop-like ribbon structures and one ring having a smaller diameter than the other.

6. An electron emitter assembly according to claim 5 wherein the inner surface of the inner ring is a concave surface.

7. An electron emitter assembly according to any one of claims 1 to 6 wherein said rings are fabricated from a material selected from the class consisting of tungsten, thoriated tungsten and tantalum.

* * * * *